United States Patent [19]

Hankins

[11] Patent Number: 4,482,072

[45] Date of Patent: Nov. 13, 1984

[54] PRESSURIZING APPARATUS FOR PARTIALLY FILLED CONTAINERS

[76] Inventor: Ronald W. Hankins, 1882 Fleming St., Pomona, Calif. 91766

[21] Appl. No.: 493,777

[22] Filed: May 12, 1983

[51] Int. Cl.[3] ..... B65D 39/12

[52] U.S. Cl. ..... 215/269; 215/231

[58] Field of Search ..... 215/231, 269, 228; 220/232

[56] References Cited

U.S. PATENT DOCUMENTS 713,708 11/1902 Spire ..... 215/269

4,392,578 7/1983 Fipp et al. ..... 215/269 X

*Primary Examiner*—Donald F. Norton

*Attorney, Agent, or Firm*—Edgar W. Averill, Jr.

[57] ABSTRACT

A closure for partially filled containers which has an interconnecting opening from outside of the container to the unfilled portion of the inside of the container and bladder which is inflatable within the container. A valve apparatus is located within the opening within the closure which, when actuated by an operator, allows pressurized air to enter the inflatable bladder. A simple hand operated pump apparatus can readily provide pressurized air to inflate the bladder. A simple method of depressurizing the expanded bladder is provided by simply depressing an extended portion of the valve apparatus releasing the pressurized air from within the bladder.

8 Claims, 4 Drawing Figures

PRESSURIZING APPARATUS FOR PARTIALLY FILLED CONTAINERS

BACKGROUND OF THE INVENTION

The field of the invention relates to container closures, and more particularly relates to closures of the type useful on previously opened partially filled containers. Such closures are used in order to retain the quality of the product for future use.

Conventional devices and methods of reclosing such product containers after they have been opened have proved to be ineffective. The existing closures available have failed, in most instances, to preserve the original quality of the stored product once a container has been opened. Attempts to keep such products, as for example, carbonated beverages and the like, inevitably fails to prevent a substantial loss of the carbonation and leads to the loss of flavor and quality of the product in later use. Even if the closure is air tight, a half filled two liter bottle of carbonated beverage will become flat as a result of a portion of the carbon dioxide leaving the liquid and escaping into the air within the bottle. Thus, the gastight closing of a partially filled carbonated beverage bottle is not sufficient to preserve the original level of carbonation. Many products lose their effectiveness in taste, aroma and composition by the escapement of volatile ingredients within the product and by exposing the product to contaminated atmosphere. Thus, the need for a better closure in such matters is well appreciated and realized by those familiar in such art.

SUMMARY OF THE INVENTION

A primary object of this invention is to provide a container closure that will reduce or eliminate product deterioration by loss of a volatile portion thereof in a partially filled container. The present invention provides for a closure that can be installed onto a dispensing outlet of a product container after the original closure has been opened and removed and a portion of the contents have been used.

The invention basically has a port arrangement through the closure that permits the pressurization of air or gas within a bladder which is within the area of the product container from which a portion of the product has already been removed. A valve arrangement is installed within the port and such valve structure permits pressurized air or gas to be brought into the container area. The same valve can be opened to permit the pressurized air or gas to be exhausted from the container when it is again desired to ready the product for removal from the container.

An expandable bladder is attached to the closure within the container and this bladder displaces a portion of the space of the partially filled container where some of the product had been removed. This space is displaced when pressurized air or gas is admitted to the inside of the bladder element by way of the port and valve within the closure.

The valve is easily moved into position for allowing the pressurized air to enter the bladder or for the elimination of the air from the bladder when it is so desired.

DESCRIPTION OF THE PREFERRED EMBODIMENTS

Figure 1:
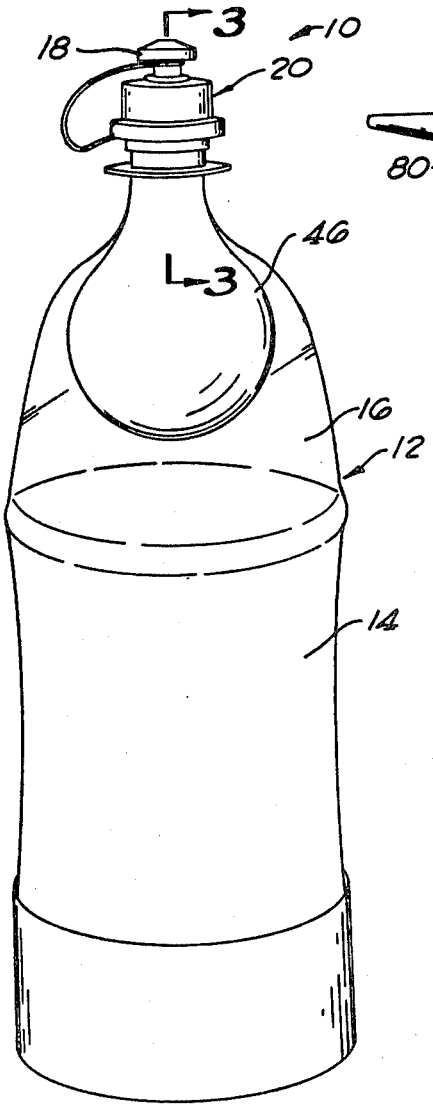
FIG. 1 is a perspective view of a container utilizing the pressurization apparatus of the invention.

The illustration of FIG. 1 shows a pressurization apparatus generally indicated by reference character 10 and showing the manner in which it is installed for use onto a partially filled beverage container 12. The beverage container is shown with the stored material 14, which in this case is a liquid. For purposes of explanation, it will be assumed that the liquid in the drawings is a carbonated beverage although other liquids or substances may also benefit from the use of the device of the present invention. An area devoid of the liquid is shown at 16 and is generally filled with atmosphere along with partial amounts of gases (such as carbon dioxide) and aromas which are released from the stored product.

Figure 4:
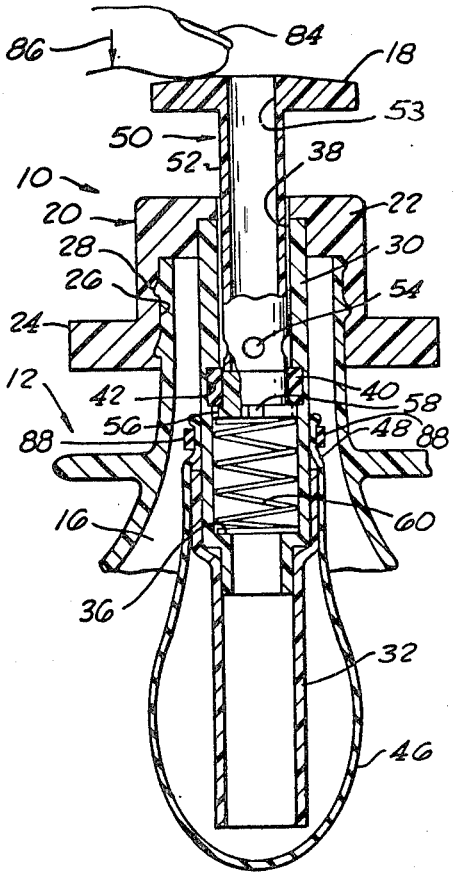
FIG. 4 is a view similar to FIG. 3 showing the pressurization apparatus in deactivated condition.
Figure 3:
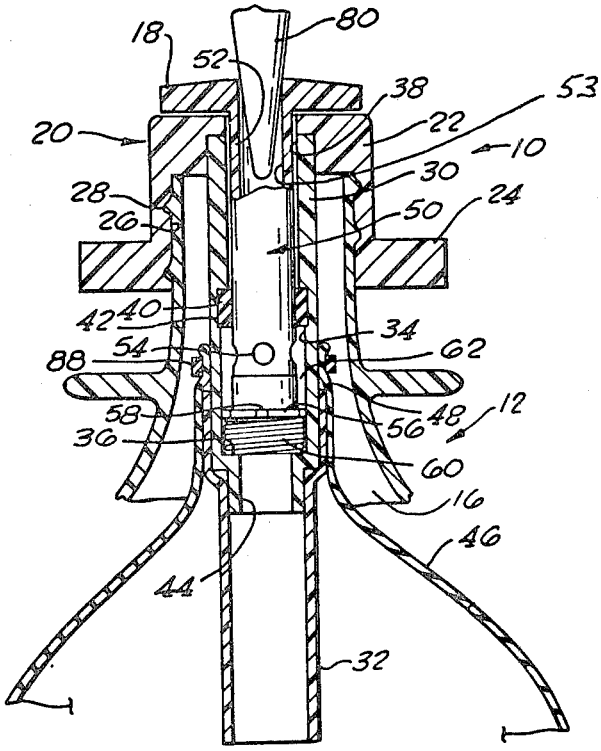
FIG. 3 is an enlarged fragmentary section, partly in elevation, of the pressurization apparatus of FIG. 1 as it is viewed along line 3—3 of FIG. 1.

The pressurization apparatus is shown with a cap 20 that is screwed onto the pouring spout portion of the container. A push button ring 18 is formed at the upper end of the apparatus. The cap 20 is shown in FIGS. 3 and 4 as having a main body 22 formed integrally with a flange portion 24. The cap has an exterior surface and an interior surface which is intended to initiate that portion of the cap which is within the neck of the bottle when the cap is affixed to a bottle. The cap includes a recessed portion 26 formed with internal threads 28. (Typically a gasket of some sort would be positioned between the bottle top and cap although such a gasket is not shown in the drawings since it is not believed necessary to depict the present invention.) These threads accommodate matching external threads already provided on the spout portion of the container. The method of attachment of closures to containers is well known to those versed in the art, which in many instances can include snap-on type of a closure.

A downwardly depending tubular member 30 is affixed to the cap body 22 and is provided with a flexible bladder guide which projects into the container. Bladder guide 32 assists in inserting the bladder into the container. A cylindrical chamber 34, located within the member 30, is formed with stop shoulder 36 at is lower end. This chamber extends into an upper port opening 38. The opening 38 terminates below the uppermost surface of cap 20. A seal member 40 is shown being retained within a groove 42 located in the chamber 34. A port 44 interconnects the chamber 34 to the lowermost end of the tubular member 30. An expandable bladder 46 is affixed at 48 by a sealing band 88 to the outside cylinder surface of the tubular member 30 and the expandable bladder prevents the contact of any exterior pressurized air or gas from the chamber area 34 with the existing air or gases within the container 12 or its stored product.

Located within the chamber area 34 is a valve element 50. The valve element comprises an upwardly directed hollow tubular member 52 which is formed with an axial cylindrical opening 53 a plurality of openings 54 perpendicular to the axis of tubular member 52 and is provided with a flange 56 at its lower end. The flange 56 bears upwardly against the seal member 40 when the member 50 is in its closed condition. A plurality of small notches 58 are shown provided at the peripheral edge of the flange 56 in order to allow the flow of air or gas, as the case may be, to pass through the openings 54 into the chamber 62 and ultimately into the inside of the bladder element 46. Thus, a gas passageway is provided through axial opening 53, perpendicular openings 54, cylindrical chamber 34, notches 58 and port 44 which directs gas between the interior of the bladder 46 and the atmosphere or a source of pressurized gas. When downward movement is administered to the valve member 50 and it is forced against the bias of a spring member 60, the valve is moved into the position shown in FIG. 3. Air or gas can then be injected into the bladder from outside the container. The downward movement as illustrated in FIG. 3 is accomplished by an operator's finger pressing down on the push button ring 18 or by a downward force exerted by the air pump or other gas pressurizing device.

Figure 2:
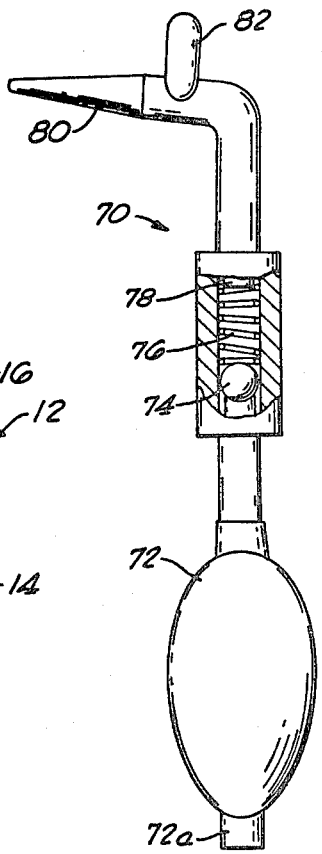
FIG. 2 is a side elevation, partly in section, of a hand-operated inflating device used in pressurizing the unfilled portion of the container of FIG. 1.

FIG. 2 shows a simple pump mechanism 70 that can be used to inject air or other gas into the bladder. A hand operated bulb made of rubber, or the like, forces air past a spring biased ball valve 74 into a port 78. Spring 76 returns the ball to its initial position after the bulb had been emptied of air. Inlet valve **72*a* then allows an additional supply of air to enter the bulb during its retainment of its initial shape in a conventional manner known well to those skilled in the art. The compressed air is forced through spout 80** into the pressurization device of the invention.

As shown in FIG. 3, the spout is inserted into the upper end of the axial, cylindrical opening 53 and the combination of spout and tube are pressed down into the closure apparatus located in the pouring spout neck of the container. A stub handle 82 helps the operator guide the spout into the pressurization device assembly.

FIGS. 1 and 3 show the bladder 46 expanded to occupy gaseous area 16, thus keeping the non-liquid area of the container in a pressurized condition. The injection of air or gas can be accomplished by various types of power operated air pumps or by the simple addition of a compressed gas from a pressurized container. The materials used for the cap and bladder are materials that are well known in the field of plastics and rubber-like materials and should be made of materials resistant to the anticipated atmosphere. When it is desired to reopen the container for use, the person conducting the procedure need only to depress the push ring 18 with a finger 84 into the direction of arrow 86. This procedure is shown in FIG. 4. It should be noted that the device of the present invention is far more effective than merely pumping air into the partially filled container. The use of the bladder concentrates the carbon dioxide and other volatile gases in the space above the liquid. A liquid upon standing will attempt to reach an equilibrium state with the gas above it. In the case of a carbonated beverage, the carbon dioxide will escape until sufficient carbon dioxide has entered the gas so that it is reabsorbed into the liquid at the same rate that it escaped. If the bottle is left open, eventually all the carbon dioxide will escape since the concentration of carbon dioxide above the liquid will never increase. Typical closures, of course, do not occupy any significant part of the void area of a partially emptied container. If the partially filled container is merely pressurized without the use of a bladder, a relatively large amount of carbon dioxide will have to escape before its concentration is such that equilibrium is reached. On the other hand if a bladder is used and, for instance 75% of the air/gas mixture is displaced, only about one fourth of the carbon dioxide will escape before equilibrium is reached.

While the above description refers to the use of the device of the present invention particularly for beverage bottles, other uses are anticipated. For instance some chemicals used in the developing of film deteriorate readily after opening and the life of such materials can be extended by the use of the above-described device. Of course, the partially filled container may contain a solid in place of a liquid.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A container closure apparatus which permits both the introduction and removal of a pressurized gas from an expandable bladder locatable within the unfilled portion of a partially filled product container, which comprises:

a removable container closure having means for affixing said closure to a product container said closure having a gas passageway therethrough said gas passageway having an exterior end and an interior end;

air valve apparatus located within said gas passageway, said air valve apparatus comprising a downwardly depending tubular member having a lower opening open to an expandable bladder and having an axially movable valve element held axially therein, said valve element having an upper opening for the insertion of tapered spout means and being biased upwardly and having valve seat means which stops the passage of gas when said valve element is in its upward position and permit the flow of gas when said valve element is in a lower position; and an expandable bladder affixed to the interior end of said container closure.

2. The apparatus of claim 1 wherein the downwardly depending tubular member has an intermediate cylindrical opening and said valve element is closed at one end and has an enlarged flange at its closed end, the flange being of such a diameter as to moveably fit within said intermediate opening, and said flange being provided with a plurality of spaced openings at its peripheral edge;

an annular seal member located at one end of said intermediate cylindrical opening, said seal member having an opening through which said valve element can slideably move;

a plurality of interconnecting openings in the wall of said valve element located adjacent the closed end and at such a distance away from said closed end when said valve element is moved downwardly beyond said sealing member, air can pass through said valve element into the inside of said bladder; and bias means located between the lowermost end of said intermediate cylindrical opening and the flange of said valve element.

3. The apparatus as set forth in claim 2 wherein said expandable bladder is attached about the lower opening of the downwardly depending tubular member.

4. The apparatus as set forth in claim 2 wherein the bias means is a spring.

5. The apparatus as set forth in claim 4 further including tapered spout means inserted into the upper opening of said valve element to actuate said valve element to bring compressed air or gas through said spout means into the expandable bladder.

6. The closure of claim 2 further including a flexible bladder guide affixed to the valve element and extending downwardly from said valve element into said expandable bladder.

7. The apparatus as set forth in claim 1 wherein the means for affixing said closure to a product container comprises a cap closure which is provided with internal threads to correspond with matching threads on the neck of said container.

8. The apparatus as set forth in claim 1 wherein the valve element projects upwardly out of the closure a sufficient distance to be actuated by a human finger.

* * * * *